US006028598A

United States Patent [19]

Suyama et al.

[11] Patent Number: 6,028,598

[45] Date of Patent: Feb. 22, 2000

[54] LIQUID CRYSTAL DRIVING POWER SUPPLY CIRCUIT

[75] Inventors: Takeshi Suyama; Shoichi Iwamoto, both of Yokohama, Japan

[73] Assignee: Kabushiki Kaisha Toshiba, Kawasaki, Japan

[21] Appl. No.: 08/856,152

[22] Filed: May 14, 1997

Related U.S. Application Data

[63] Continuation of application No. 08/240,431, May 10, 1994, abandoned.

[30] Foreign Application Priority Data

May 10, 1993 [JP] Japan ..... 5-108421

[51] Int. Cl.[7] ..... G09G 3/18

[52] U.S. Cl. ..... 345/211; 345/95; 345/210

[58] Field of Search ..... 345/88, 87, 95, 345/211, 212, 210; 327/170, 108, 530, 437

[56] References Cited

U.S. PATENT DOCUMENTS

| | | | |
|---|---|---|---|
| 4,139,880 | 2/1979 | Ulmer et al. | 327/437 |
| 5,070,255 | 12/1991 | Shin | 345/211 |

FOREIGN PATENT DOCUMENTS

| | | | |
|---|---|---|---|
| 0 479 304 | 4/1992 | European Pat. Off. . | |
| 0 531 615 | 3/1993 | European Pat. Off. . | |
| 40 09 404 | 9/1991 | Germany . | |
| 63-149913 | 6/1988 | Japan | 327/108 |
| 01178930 | 7/1989 | Japan | 345/95 |
| 3166589 | 7/1991 | Japan . | |
| 03230116 | 10/1991 | Japan | 345/95 |
| 03230117 | 10/1991 | Japan | 345/211 |
| 0497283 | 3/1992 | Japan | 345/95 |
| 4097283 | 3/1992 | Japan | 345/95 |
| 04143791 | 5/1992 | Japan | 345/212 |
| 5150736 | 6/1993 | Japan . | |
| 05257121 | 10/1993 | Japan | 345/211 |

*Primary Examiner*—Lun-Yi Lao

*Attorney, Agent, or Firm*—Oblon, Spivak, McClelland, Maier & Neustadt, P.C.

[57] ABSTRACT

Five voltage dividing resistors are connected in series between the nodes of external power supply voltages to obtain first to fourth divided voltages. A first power amplifier of an Ntop type for impedance conversion is connected to a node of the first voltage. A second power amplifier of a Ptop type for impedance conversion is connected to a node of the second voltage. A third power amplifier of the Ntop type for impedance conversion is connected to a node of the third voltage. A fourth power amplifier of the Ptop type for impedance conversion is connected to a node of the fourth voltage. In each of the first and third power amplifiers of the Ntop type, the ability of causing a current to flow out of the amplifier from the output terminal is set to be high, and the ability of causing a current to flow into the amplifier from the output terminal is set to be low. In each of the second and fourth power amplifiers of the Ptop type, the ability of causing a current to flow into the amplifier from the output terminal is set to be high, and the ability of causing a current to flow out of the amplifier from the output terminal is set to be low.

11 Claims, 6 Drawing Sheets

LIQUID CRYSTAL DRIVING POWER SUPPLY CIRCUIT

This application is a continuation of application Ser. No. 08/240,431 filed on May 10, 1994, now abandoned.

BACKGROUND OF THE INVENTION

1. Field of the Invention

The present invention relates to a liquid crystal driving power supply circuit for generating a plurality of power supply voltages having different values used to drive a liquid crystal display panel.

2. Description of the Related Art

Liquid crystal display panels have low power consumption and a small size. Owing to these advantages, the liquid crystal display panels are used as the display units of portable electronic devices such as electronic desk calculators and electronic pocketbooks. In order to drive such a liquid crystal display panel, a plurality of voltages having different values are required. These liquid crystal driving voltages are generally formed by a voltage dividing operation using a plurality of resistors arranged between power supplies. The maximum value of a current which can be caused to flow from the node of each voltage formed by such a voltage dividing operation is determined by the value of each of the plurality of resistors. Therefore, the amount of current flowing from the node of each voltage may be increased by decreasing the value of each resistor. In this case, however, a large amount of current flows between the power supplies, resulting in an increase in power consumption. On the other hand, in order to decrease this power consumption, the value of each resistance may be increased to decrease the amount of current flowing between the power supplies. In this case, however, the amount of current which can be caused to flow from the node of each voltage decreases. If a large current flows from each node, the voltage of each node decreases, and the value of each voltage cannot be maintained at a specified value.

In general, in order to solve the above problem, a resistor having a high resistance is used as each voltage dividing resistor to achieve a reduction in power consumption, and each divided voltage is received by a power amplifier to achieve a reduction in the impedance of an output. The power amplifier has a differential input stage and an output stage. The differential input stage receives the respective divided voltages described above and an output voltage from the output stage connected to the differential input stage. The output stage has a constant-current source and a driving transistor to which an output from the differential input stage is supplied. Sufficiently large currents need to be supplied to the constant-current source and the driving transistor on the output stage to maintain an output voltage at a predetermined value even if a large current flows from or into the power amplifier. Consequently, the power consumption of the power amplifier increases, and the effect obtained by using a resistor having a high resistance as each voltage dividing resistor is reduced. This results in shortening the service life of a battery in a portable electronic device which is driven by the battery.

SUMMARY OF THE INVENTION

It is, therefore, an object of the present invention to provide a liquid crystal driving power supply circuit which can further reduce the current consumption.

According to the present invention, there is provided a liquid crystal driving power supply circuit comprising a first node to which a first power supply voltage is applied, a second node to which a second power supply voltage is applied, voltage dividing means for dividing a voltage between the first and second nodes into a plurality of voltages, first impedance conversion means, having a first output terminal and an ability of causing a current to flow from the first output terminal to the second node, the ability being set to be higher than an ability of causing a current to flow from the first node to the first output terminal, for receiving a first divided voltage obtained by the voltage dividing means and outputting a voltage corresponding to the first divided voltage, and second impedance conversion means, having a second output terminal and an ability of causing a current to flow from the first node to the second output terminal, the ability being set to be higher than an ability of causing a current to flow from the second output terminal to the second node, for receiving a second divided voltage having a value nearer to the second power supply voltage than the first divided voltage and obtained by the voltage dividing means, and for outputting a voltage corresponding to the second divided voltage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The above and other objects, features, and advantages of the present invention will be apparent from the following detailed description in conjunction with the accompanying drawings.

Figure 1:
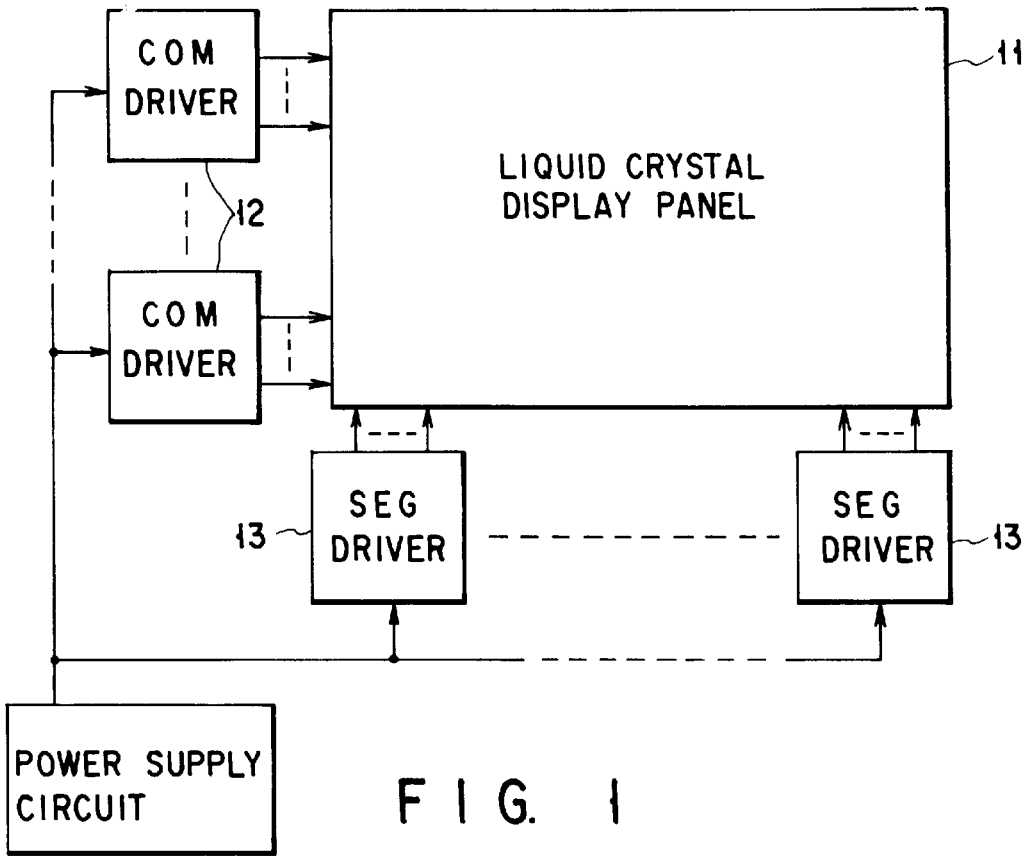
FIG. 1 is a block diagram showing a circuit arrangement around a display panel.

A liquid crystal display panel 11 shown in FIG. 1 is basically designed such that a liquid crystal is sandwiched between two glass plates having a large number of wiring lines formed on their surfaces in orthogonal directions. In general, a plurality of first electrodes (to be referred to as common electrodes hereinafter) (not shown) called common electrodes, scanning electrodes, or the like extend from the liquid crystal display panel 11 in the lateral direction, whereas a plurality of second electrodes (to be referred to as segment electrodes hereinafter) (not shown) called segment electrodes, data electrodes, or the like extend from the liquid crystal display panel 11 in the vertical direction. When a predetermined potential is applied between one common electrode and a corresponding segment electrode, a segment consisting of a capacitor constituted by two wiring lines connected to the two electrodes and a liquid crystal located therebetween is turned on/driven. ON/OFF driving control of this segment is performed by using liquid crystal driving integrated circuits called a COM driver 12 on the common electrode side and a SEG driver 13 on the segment electrode side, respectively.

In general, the numbers of common electrodes and segment electrodes are considerably large, even though they vary depending on the type of a liquid crystal display panel. For example, some liquid crystal display panel has 64 common electrodes and 160 segment electrodes. For this reason, a plurality of COM drivers 12 and SEG drivers 13 are generally formed on the common side and the segment side, respectively. These COM drivers 12 and SEG drivers 13 generate driving signals on the basis of various types of control signals and display data, and supply the signals to the corresponding common and segment electrodes of the liquid crystal display panel 11. In order to generate driving signals in the COM drivers 12 and the SEG drivers 13, a plurality of liquid crystal driving voltages having different values are required. These voltages are generated by a power supply circuit 14. This power supply circuit 14 may be incorporated in any one of the COM drivers 12 or of the SEG drivers 13, or may be integrated into one integrated circuit together with all the COM and SEG drivers 12 and 13.

In general, a plurality of liquid crystal driving voltages having different values are formed by a voltage dividing operation using a plurality of resistors arranged between power supplies. The current driving abilities of the formed voltages are determined by the values of the voltage dividing resistors. In order to improve the current driving ability of each voltage, i.e., increase the amount of current flowing from the node of each voltage, the value of each voltage driving resistor may be increased. In this case, however, a large amount of current flows between the power supplies to increase the power consumption of the power supply circuit 14. On the other hand, in order to reduce the power consumption, the value of each voltage dividing resistor may be increased to decrease the amount of current flowing between the power supplies. In this case, however, the current driving ability at the node of each voltage deteriorates, and the voltage cannot be maintained if a large amount of current flows.

Figure 2:
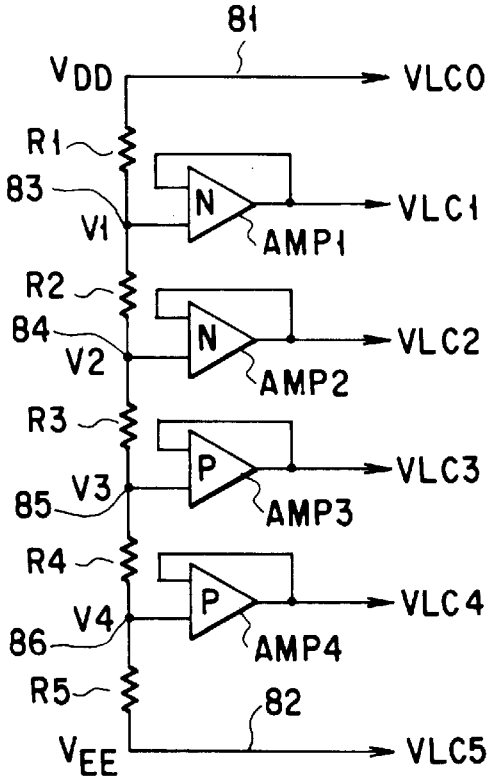
FIG. 2 is a circuit diagram of a power supply circuit arranged in the circuit in FIG. 1.

In order to eliminate the above contradiction, each voltage obtained by a voltage dividing operation is generally received by a power amplifier. FIG. 2 shows the arrangement of a power supply circuit using this power amplifier. Referring to FIG. 2, voltages VDD and VEE are external power supply voltages which are externally applied. For example, the value of the voltage VDD is set to 0 V, and the value of the voltage VEE is set to −10 V, which can be arbitrarily changed with −10 V being set as the minimum value. Five voltage dividing resistors R1 to R5 are series-connected between a node 81 of the voltage VDD and a node 82 of the voltage VEE. As these voltage dividing resistors R1 to R5, resistors having high resistances are used to sufficiently decrease the value of a DC current flowing between the node 81 of the voltage VDD and the node 82 of the voltage VEE so as to restrict the power consumption to a small value. In general, of the five resistors, the resistors R1 and R2 located near the node of the voltage VDD, and the resistors R4 and R5 located near the node of the voltage VEE are all set to, for example, the same value. The resistor R3 between these resistors is set to, for example, a predetermined multiple of the value of the resistors R1, R2, R4, and R5. The voltage VDD, the voltage VEE, and four voltages obtained at series-connected nodes 83, 84, 85, and 86 of the respective resistors, i.e., a total of six voltages, are applied, as liquid crystal driving voltages VLC0, VLC1, VLC2, VLC3, VLC4, and VLC5, to the COM drivers 12 and the SEG drivers 13. For example, in the COM drivers 12 and the SEG drivers 13, the voltages VLC0, VLC1, VLC4, and VLC5 are used as the common electrode driving voltages, and the voltages VLC0, VLC2, VLC3, and VLC5 are used as the segment driving voltages.

Although the voltages VLC0 and VLC5, which are identical to the external power supply voltages VDD and VEE, have sufficiently high current driving abilities, voltages V1, V2, V3, and V4, which are formed by a voltage dividing operation using the resistors having high resistances, do not have sufficiently high current driving abilities. For this reason, as shown in FIG. 2, the divided voltages V1, V2, V3, and V4 are respectively received by power amplifiers AMP1, AMP2, AMP3, and AMP4, which are designed to perform impedance conversion, to obtain low-impedance outputs, which are applied, as the voltages VLC1, VLC2, VLC3, and VLC4, to the COM drivers 12 and the SEG drivers 13.

As the above power amplifiers, amplifiers having CMOS structures constituted by p- and n-channel MOS transistors are used. As the two power amplifiers AMP1 and AMP2 for receiving the divided voltages V1 and V2 near the voltage VDD, Ntop type amplifiers constituted by n-channel MOS transistors for receiving input voltages are used. As the two power amplifiers AMP3 and AMP4 near the voltage VEE, Ptop type amplifiers constituted by p-channel MOS transistor for receiving input voltages are used.

Figure 3:
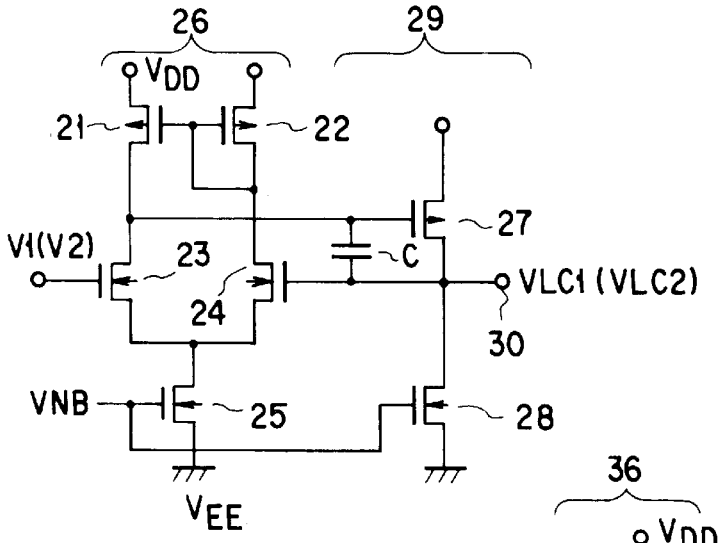
FIG. 3 is a circuit diagram of a power amplifier used in the power supply circuit in FIG. 2.

As shown in FIG. 3, each of the Ntop type power amplifiers AMP1 and AMP2 is constituted by a differential amplification stage 26 and an output stage 29. The differential amplification stage 26 includes p-channel MOS transistors 21 and 22 serving as a current mirror load, n-channel MOS transistors 23 and 24 serving as a differential input pair, and an n-channel MOS transistor 25 as a constant-current source. The output stage 29 includes a p-channel MOS transistor 27 as a driving transistor for receiving an output from the differential amplification stage 26, and an n-channel MOS transistor 28 as a constant-current source. Note that a bias voltage VNB is applied to the gate of each of the MOS transistors 25 and 28.

Figure 4:
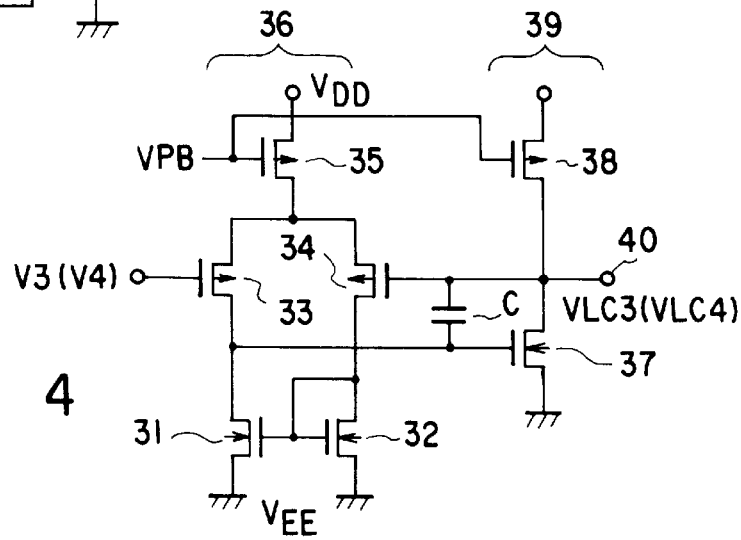
FIG. 4 is a circuit diagram of another power amplifier used in the power supply circuit in FIG. 2.

As shown in FIG. 4, each of the Ptop type power amplifiers AMP3 and AMP4 is constituted by a differential amplification stage 36 and an output stage 39. The differential amplification stage 36 includes n-channel MOS transistors 31 and 32 serving as a current mirror load, p-channel MOS transistors 33 and 34 serving as a differential input pair, and a p-channel MOS transistor 35 as a constant-current source. The output stage 39 includes an n-channel MOS transistor 37 as a driving transistor for receiving an output from the differential amplification stage 36, and a p-channel MOS transistor 38 as a constant-current source. Note that a bias voltage VPB is applied to the gate of each of the MOS transistors 35 and 38. Both capacitors C in FIGS. 3 and 4 serve to prevent oscillation so as to stabilize operations.

Figure 5:
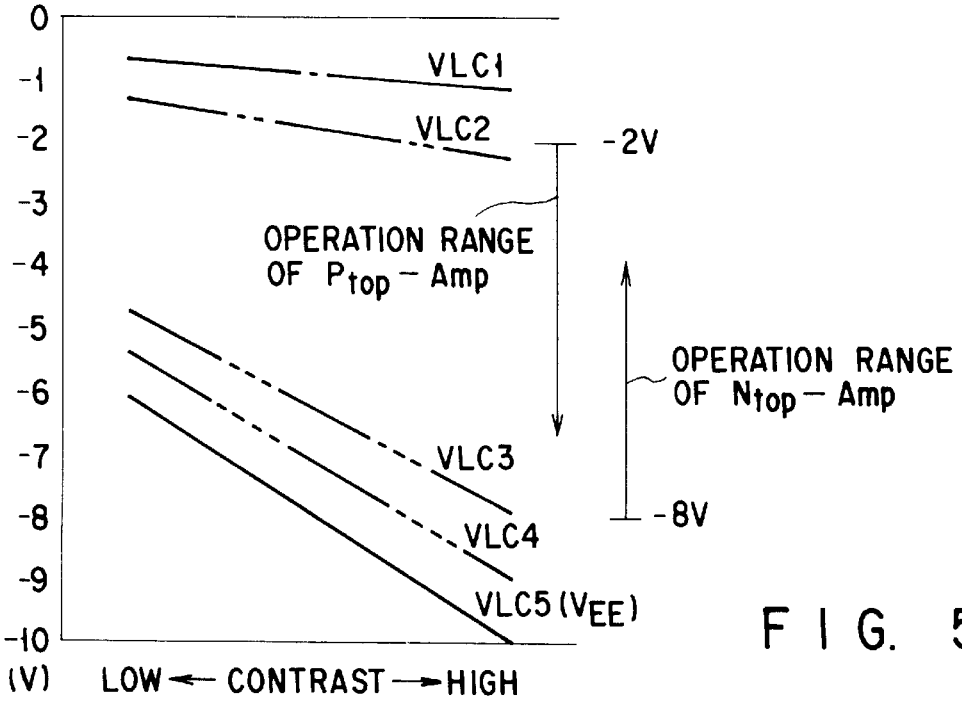
FIG. 5 is a graph showing the power supply voltage dependency of each liquid crystal driving voltage obtained by the power supply circuit in FIG. 2.

FIG. 5 is a graph showing the voltage VEE dependencies of the respective liquid crystal driving voltages generated by the power supply circuit in FIG. 2, except for the voltage VLC0 identical to the voltage VDD, i.e., the voltage VEE dependencies of the voltages VLC1 to VLC5. In a general liquid crystal display panel, the external power supply voltage VEE can be adjusted to freely set a display contrast to some extent. In general, as the voltage VEE is changed toward −6 V, the contrast weakens, whereas as the voltage changes toward −10 V, the contrast strengthens. The values of the voltages VLC0 to VLC5 become the maximum values (near 0 V) when the voltage VEE is −6 V, and become the minimum values (large negative values) when the voltage VEE is −10 V.

Voltages exhibiting changes like those shown in FIG. 5 are input to the four power amplifiers AMP1 to AMP4. For this reason, as the power amplifiers AMP1 to AMP4, amplifiers having performance levels corresponding to the respective input voltages must be selected. A power amplifier having an n-channel MOS transistor for receiving an input voltage, i.e., an Ntop type power amplifier, does not operate unless the gate voltage (input voltage) of the n-channel MOS transistor 23 in FIG. 3 is higher than the source voltage by the corresponding threshold voltage or more. A power amplifier having a p-channel MOS transistor for receiving an input voltage, i.e., a Ptop type power amplifier, does not operate unless the gate voltage (input voltage) of the p-channel MOS transistor 33 in FIG. 4 is lower than the source voltage by the absolute value of the corresponding threshold voltage or more. It is generally known that there are variations in the threshold voltage of a MOS transistor. Assume that the maximum absolute values of the threshold voltages of n- and p-channel MOS transistors are 1 V, in consideration of such variations in threshold voltage. In this case, as shown in FIG. 5, the input voltage range in which the Ntop type power amplifiers AMP1 and AMP2 (Ntop-Amps) satisfactorily operate is −8 V or more when the voltage VEE is −10 V. The input voltage range in which the Ptop type power amplifiers AMP3 and AMP4 (Ptop-Amps) satisfactorily operate is −2 V or less when the voltage VEE is −10 V.

In this case, Ntop-Amps are used as the power amplifiers AMP1 and AMP2 for receiving voltages whose values may become −2 V or more, whereas Ptop-Amps are used as the power amplifiers AMP3 and AMP4 for receiving voltages whose values may become −8 V or less.

Figure 6:
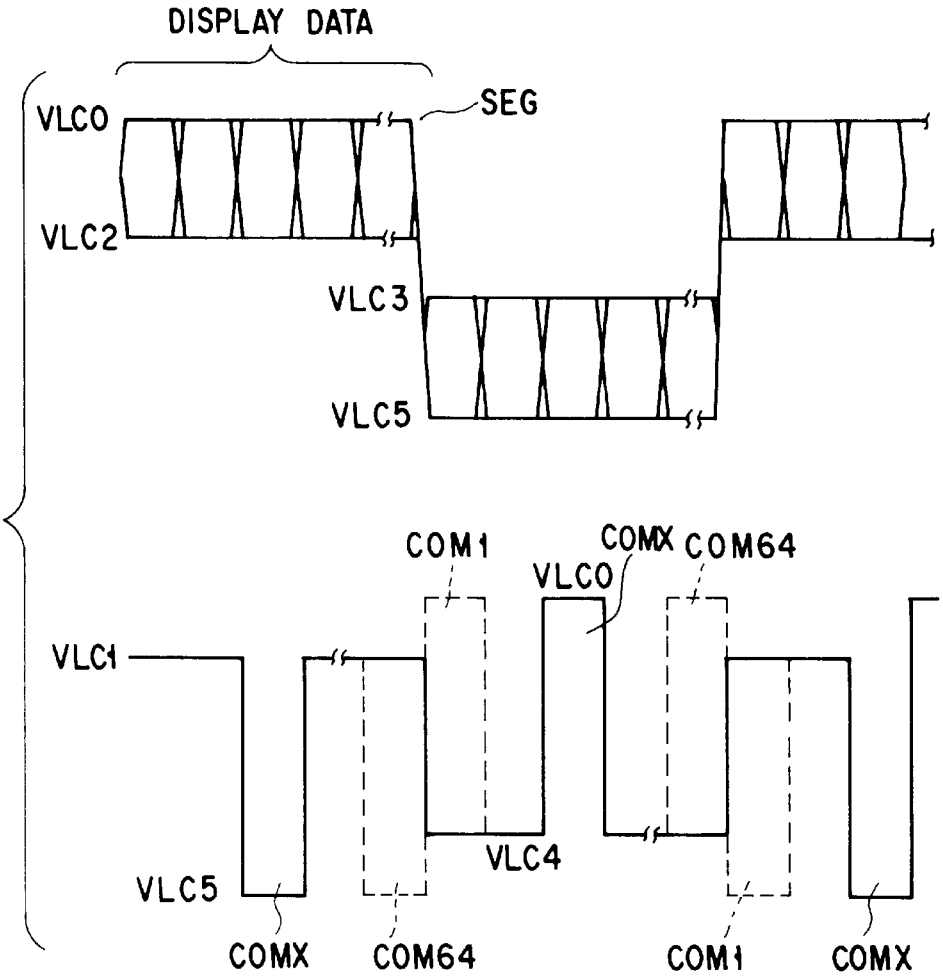
FIG. 6 is a chart showing examples of the waveforms of a common driving signal and a segment driving signal, both generated by the circuit in FIG. 1.

FIG. 6 shows examples of the waveforms of a common driving signal COM and a segment driving signal SEG respectively output from the COM and SEG drivers 12 and 13 in FIG. 1. The segment driving signal SEG is formed by using the four liquid crystal driving voltages VLC0, VLC2, VLC3, and VLC5. The segment driving signal SEG is alternately switched in value between VLC0 and VLC2 every time display data changes in a given half period of a frame signal as a kind of control signal, and alternately switched in value between VLC3 and VLC5 every time the display data changes in the next half period of the frame signal. The common driving signal COM is formed by using the four liquid crystal driving voltages VLC0, VLC1, VLC4, and VLC5. In a given half period of the frame signal, common driving signals, of 64 common driving signals COM1 to COM64, which have been set to VLC1 are sequentially switched to VLC5, starting from the common driving signal COM1. In the next half period of the frame signal, common driving signals which have been set to VLC4 are sequentially switched to VLC0, starting from the common driving signal COM1.

As is apparent from FIG. 6, one common driving signal COM is switched in value once for each half period of the frame signal, whereas the segment driving signal SEG is switched in value every time the display data changes. For example, the frequency of the frame signal is 35 Hz, and the frequency of a latch pulse signal for the display data is 2,240 Hz. Therefore, the amount of current flowing from the node of each of the liquid crystal driving voltages VLC0, VLC2, VLC3, and VLC5 used to form the segment driving signal SEG is larger than the amount of current flowing from the node of each of the liquid crystal driving voltages VLC1 and VLC4 used only to form the common driving signal COM.

Figure 7:
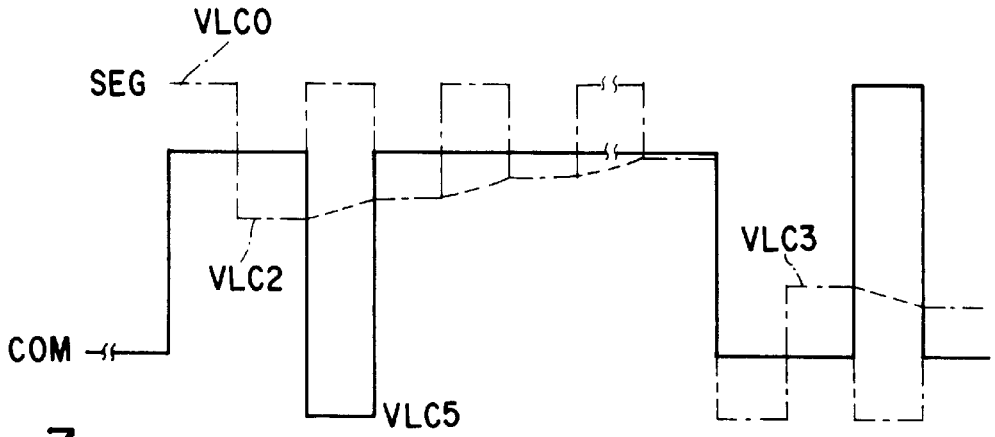
FIG. 7 is a chart showing examples of the waveforms of a common driving signal and a segment driving signal which are respectively supplied to one of the common electrodes in FIG. 6 and a segment electrode.

FIG. 7 shows examples of the waveforms of the common driving signal COM and the segment driving signal SEG respectively applied to one common electrode and a corresponding segment electrode in the liquid crystal display panel in FIG. 1. When the amount of current flowing from the node of each of the liquid crystal driving voltages VLC0, VLC2, VLC3, and VLC5 used to form the segment driving signal SEG is large, as described above, no problem is posed with respect to the voltages VLC0 and VLC5 identical to the external power supply voltages VDD and VEE, but a problem is posed with respect to the voltages VLC2 and VLC3 output from the power amplifiers AMP2 and AMP3 in FIG. 2. More specifically, in the Ntop type power amplifier AMP2 for outputting the voltage VLC2, as shown in FIG. 3, the MOS transistor 27 for charging an output terminal 30 to the voltage VDD on the output stage 29 is driven by an output from the differential amplification stage 26, and the MOS transistor 28 for discharging the output terminal 30 to the voltage VEE serves as a constant-current source. For this reason, if a current flowing in the MOS transistor 28 as the constant-current source is restricted to a small value to reduce the power consumption of the power amplifier itself, the ability of increasing the output voltage to the voltage VDD is high, but the ability of decreasing the output voltage to the voltage VEE is low. For this reason, as shown in FIG. 7, the value of the voltage VLC2 of the segment driving signal SEG is increased toward the power supply voltage VDD (VLC0) and is sequentially increased toward the voltage VLC0. In contrast to this, in the Ptop type power amplifier AMP3 for outputting the voltage VLC3, as shown in FIG. 4, the MOS transistor 37 for discharging an output terminal 40 to the voltage VEE on the output stage 39 is driven by an output from the differential amplification stage 36, and the MOS transistor 38 for charging the output terminal 40 to the voltage VDD serves as a constant-current source. For this reason, if a current flowing in the MOS transistor 38 as the constant-current source is restricted to a small value to reduce the power consumption of the power amplifier itself, the ability of decreasing the output voltage to the voltage VEE is high, but the ability of increasing the output voltage to the voltage VDD is low. For this reason, as shown in FIG. 7, the value of the voltage VLC3 of the segment driving signal SEG is decreased toward the power supply voltage VEE (VLC5) and is sequentially decreased toward the voltage VLC5. In order to prevent such variations in output voltage, a relatively large current is supplied to the constant-current source of each power amplifier to simultaneously improve both the abilities of causing a current to flow into and out of each power amplifier through the output terminal. With this operation, the output impedances of all the power amplifiers are decreased to prevent the above-described variations in output voltage.

If, however, large currents flow in the constant-current source of all the power amplifiers, the current consumption of each power amplifier increases, resulting in a reduction in the effect of reducing the power consumption which is obtained by using resistors having high resistances as voltage dividing resistors. Especially in a portable electronic device driven by a battery, the service life of the battery is shortened.

Figure 8:
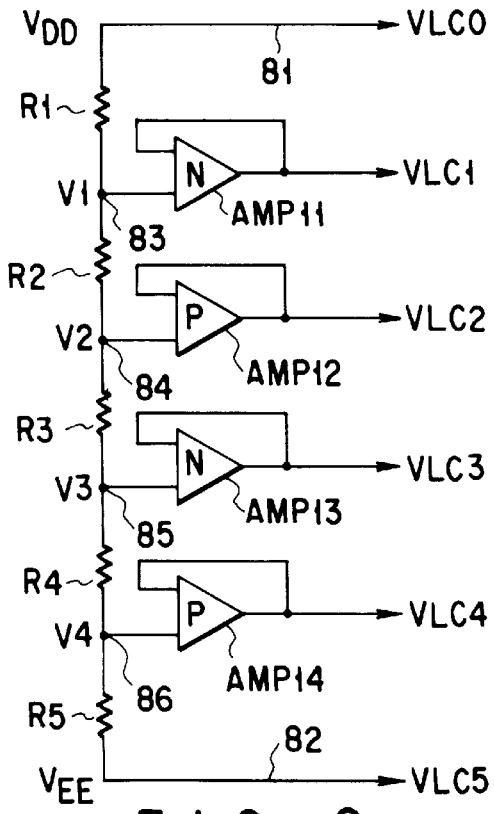
FIG. 8 is a circuit diagram of the first embodiment of the present invention.

FIG. 8 shows the detailed arrangement of the power supply circuit 14 in the electronic device in FIG. 1 according to the first embodiment of the present invention.

Voltages VDD and VEE are external power supply voltages which are externally applied. For example, the value of the external power supply voltage VDD is set to 0 V, and the value of the external power supply voltage VEE is set to −10 V, which can be arbitrarily changed with −10 V being set as the minimum value. Five voltage dividing resistors R1 to R5 are series-connected between a node 81 of the voltage VDD and a node 82 of the voltage VEE. As these voltage dividing resistors R1 to R5, resistors having high resistances are used to sufficiently decrease the value of a DC current flowing between the node 81 of the voltage VDD and the node 82 of the voltage VEE so as to restrict the power consumption to a small value. Similar to the circuit shown in FIG. 2, for example, the resistors R1, R2, R4, and R5 are all set to the same value. The resistor R3 between the resistors R2 and R4 is set to, for example, a predetermined multiple of the value of the resistors R1, R2, R4, and R5. The voltage VDD, the voltage VEE, and four voltages obtained at series-connected nodes 83, 84, 85, and 86 of the respective resistors, i.e., a total of six voltages, are applied, as liquid crystal driving voltages VLC0, VLC1, VLC2, VLC3, VLC4, and VLC5, to the COM drivers 12 and the SEG drivers 13 in the circuit shown in FIG. 1. In the COM drivers 12 and the SEG drivers 13, the voltages VLC0, VLC1, VLC4, and VLC5 are used as the common electrode driving voltages, and the voltages VLC0, VLC2, VLC3, and VLC5 are used as the segment driving voltages.

In the circuit of this embodiment, power amplifiers AMP11 to AMP14 used as impedance conversion means are respectively connected to the nodes 83, 84, 85, and 86 at which divided voltages V1, V2, V3, and V4 are obtained. Output voltages from these power amplifiers AMP11 to AMP14 are applied, as the liquid crystal driving voltages VLC1, VLC2, VLC3, and VLC4, to the COM and SEG drivers 12 and 13. As the power amplifier AMP11 connected to the node 83 of the divided voltage V1, an Ntop type amplifier like the one described above is used. As the power amplifier AMP12 connected to the node 84 of the divided voltage V2, a Ptop type amplifier like the one described above is used. As the power amplifier AMP13 connected to the node 85 of the divided voltage V3, an Ntop type amplifier like the one described above is used. As the power amplifier AMP14 connected to the node 86 of the divided voltage V4, a Ptop type amplifier like the one described above is used.

FIG. 3 shows the detailed arrangement of the Ntop type power amplifiers AMP11 and AMP13. More specifically, each of the Ntop type power amplifiers AMP11 and AMP13 is constituted by a differential amplification stage 26 and an output stage 29. The differential amplification stage 26 includes p-channel MOS transistors 21 and 22 serving as a current mirror load, n-channel MOS transistors 23 and 24 serving as a differential input pair, and an n-channel MOS transistor 25 as a constant-current source. The output stage 29 includes a p-channel MOS transistor 27 as a driving transistor for receiving an output from the differential amplification stage 26, and an n-channel MOS transistor 28 as a constant-current source. FIG. 4 shows the detailed arrangement of the Ptop type power amplifiers AMP12 and AMP14. More specifically, each of the Ptop type power amplifiers AMP3 and AMP4 is constituted by a differential amplification stage 36 and an output stage 39. The differential amplification stage 36 includes n-channel MOS transistors 31 and 32 serving as a current mirror load, p-channel MOS transistors 33 and 34 serving as a differential input pair, and a p-channel MOS transistor 35 as a constant-current source. The output stage 39 includes an n-channel MOS transistor 37 as a driving transistor for receiving an output from the differential amplification stage 36, and a p-channel MOS transistor 38 as a constant-current source.

Consider the liquid crystal driving voltages VLC2 and VLC3, which pose problems as described above.

As shown in FIG. 4, the Ptop type power amplifier having the output stage 39 constituted by the n-channel MOS transistor 37 as a driving transistor and the p-channel MOS transistor 38 as a constant-current source is used as the power amplifier AMP12 for outputting the voltage VLC2, which poses a problem from the point of view that the amount of current flowing out of the amplifier is large and the value of the voltage VLC2 increases toward the voltage VLC2 when the liquid crystal display panel 11 shown in FIG. 1 performs a display operation. In this Ptop type power amplifier, a sufficient amount of current can be caused to flow into the output terminal 40 by the n-channel MOS transistor 37. Therefore, a rise in the output voltage VLC2 toward the voltage VLC0 can be prevented, and the value of the voltage VLC2 can be stably maintained. For this reason, with regard to the p-channel MOS transistor 38 used as a constant-current source in the output stage 39, the value of the output voltage is only required to be maintained, but a large current need not be supplied. When the voltage VLC2 at the output terminal 40 is lower than a specified value, a current flows in the MOS transistor 38. Otherwise, a current flows in the MOS transistor 38 via the MOS transistor 37. For this reason, a current is always consumed by the MOS transistor 38. However, as described above, since a large current need not be supplied to the p-channel MOS transistor 38, this current value can be reduced.

As shown in FIG. 3, the Ntop type power amplifier having the output stage 29 constituted by the n-channel MOS transistor 27 as a driving transistor and the n-channel MOS transistor 28 as a constant-current source is used as the power amplifier AMP13 for outputting the voltage VLC3, which poses a problem from the point of view that the amount of current flowing out of the amplifier is large and the value of the voltage VLC3 decreases toward the voltage VLC5 when the liquid crystal display panel 11 performs a display operation. In this Ntop type power amplifier, a sufficient amount of current can be caused to flow from the output terminal 30 by the p-channel MOS transistor 27. Therefore, a drop in the output voltage VLC2 toward the voltage VLC5 can be prevented, and the value of the voltage VLC3 can be stably maintained. For this reason, with regard to the p-channel MOS transistor 38 used as a constant-current source in the output stage 39, the value of the output voltage is only required to be maintained, but a large current need not be supplied. With regard to the n-channel MOS transistor 28 used as a constant-current source in the output stage 29, the value of the output voltage is only required to be maintained, and a large current need not be supplied. When the voltage VLC3 at the output terminal 30 is higher than a specified value, a current flows in the MOS transistor 28. Otherwise, a current flows in the MOS transistor 28 via the MOS transistor 27. For this reason, a current is always consumed by the MOS transistor 28. However, as described above, since a large current need not be supplied to the p-channel MOS transistor 28, this current value can be reduced. With regard to the remaining power amplifiers AMP11 and AMP14, variations in output voltage do not easily occur, and hence low current consumption can be realized. According to this embodiment, therefore, low power consumption can be realized in all the power amplifiers AMP11, AMP12, AMP13, and AMP14, and each liquid crystal driving voltage can be stabilized.

In the above embodiment, the external power supply voltage VEE is set to, e.g., −10 V and can be arbitrarily changed. For example, as this power supply voltage, a power supply voltage whose value can be arbitrarily changed up to −25 V can be used.

Figure 9:
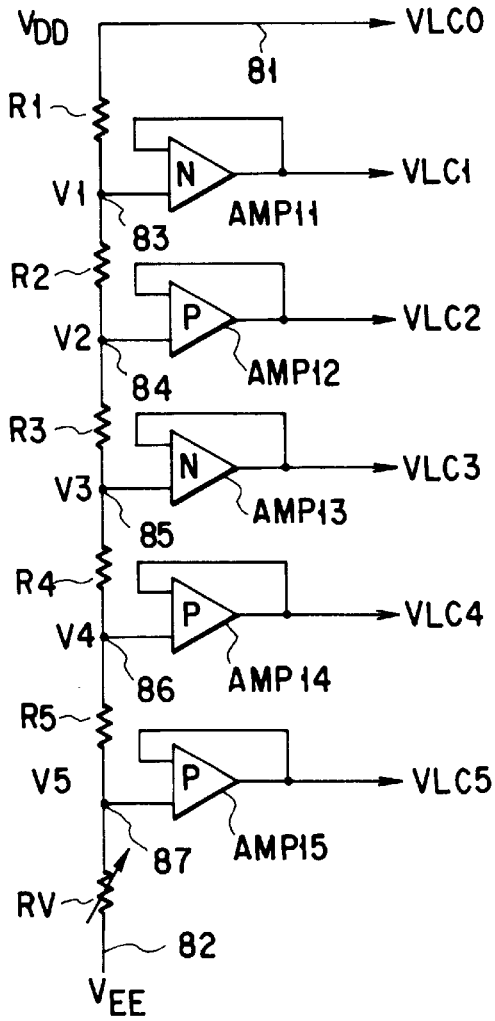
FIG. 9 is a circuit diagram of the second embodiment of the present invention.

FIG. 9 shows the circuit arrangement of a power supply circuit according to the second embodiment of the present invention. In the circuit of the embodiment shown in FIG. 8, the value of the external power supply voltage VEE is changed to set a display contrast. In the second embodiment, a variable resistor RV is inserted between the resistor R5 in FIG. 8 and a node 82 of an external power supply voltage VEE having a fixed value, and the values of liquid crystal driving voltages VLC1 to VLC5 are changed by adjusting the variable resistor RV. In this case, a voltage V5 corresponding to the voltage VLC5 is also formed by a voltage dividing operation using resistors. For this reason, a power amplifier AMP15 as an impedance conversion means is connected to a node 87 at which the voltage V5 is obtained. Note that a Ptop type amplifier like the one shown in FIG. 4 may be used as this power amplifier AMP15.

In the power supply circuits of the embodiments respectively shown in FIGS. 8 and 9, a Ptop type amplifier is used as a power amplifier AMP12 connected to a node 84 of a divided voltage V2, and an Ntop type amplifier is used as a power amplifier AMP13 connected to a node 85 of a divided voltage V3. That is, each of these circuits is of a reverse type to the circuit shown in FIG. 2. As described with reference to FIG. 5, in the circuit shown in FIG. 2, since the input voltage V2 to the power amplifier AMP2 becomes −2 V or more, a Ptop type amplifier cannot be used. Hence, an Ntop type amplifier is used. In addition, since the input voltage V3 to the power amplifier AMP3 becomes −8 V or less, an Ntop type amplifier cannot be used. Hence, a Ptop type amplifier is used. However, this does not mean that the circuit does not operate at all if a Ptop type amplifier is used as the power amplifier AMP12 for receiving the voltage V2; and an Ntop type amplifier, as the power amplifier AMP13 for receiving the voltage V3. No problem is posed if the voltages V2 and V3 are carefully set, and the threshold voltages of the MOS transistors are set to be lower, while the values can be controlled with high precision. Therefore, in the embodiments shown in FIGS. 8 and 9, Ptop and Ntop type amplifiers may be used as the power amplifiers AMP12 and AMP13, respectively. It is, however, inevitable that the margins of the operating points of the power amplifiers AMP12 and AMP13 are reduced in the circuits of the embodiments shown in FIGS. 8 and 9.

Figure 10:
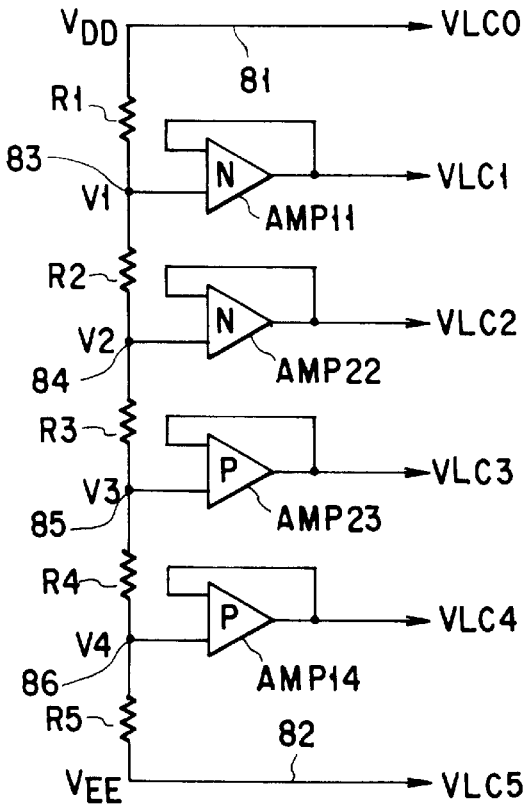
FIG. 10 is a circuit diagram of the third embodiment of the present invention.

FIG. 10 shows the arrangement of a power supply circuit according to the third embodiment of the present invention. The circuit of this embodiment shown in FIG. 10 is designed to realize low power consumption and stabilization of each liquid crystal driving voltage without reducing the margins of the operating points of power amplifiers connected to nodes 84 and 85 of voltages V2 and V3. In the circuit of the embodiment, an Ntop type power amplifier AMP22 is used in place of the Ptop type power amplifier AMP12 connected to the node 84 of the voltage V2, and a Ptop type power amplifier AMP23 is used in place of the Ntop type power amplifier AMP13 connected to the node 85 of the voltage V3. Note that as power amplifiers AMP11 and AMP14 connected to node 83 and 86 of voltages V1 and V4, the same amplifiers as those in FIG. 8 can be used.

Figure 11:
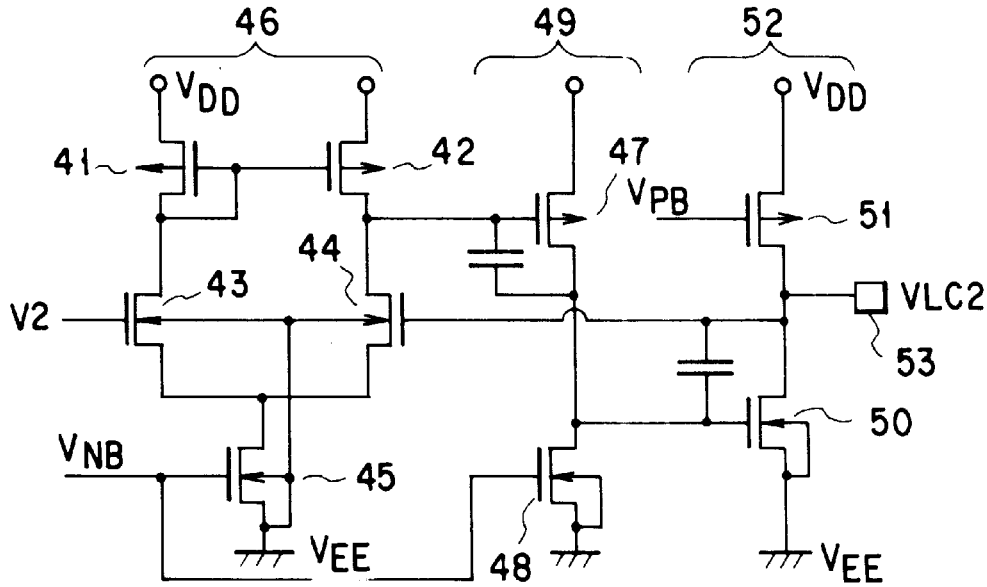
FIG. 11 is a circuit diagram of a power amplifier used in the circuit of the third embodiment in FIG. 10.

FIG. 11 shows the detailed arrangement of the Ntop type power amplifier AMP22 used in the circuit of the third embodiment. The Ntop type power amplifier AMP22 is constituted by a differential amplification stage 46, an intermediate output stage 49, and a final output stage 52. The differential amplification stage 46 includes p-channel MOS transistors 41 and 42 serving as a current mirror load, n-channel MOS transistors 43 and 44 serving as a differential input pair, and an n-channel MOS transistor 45 as a constant-current source. The intermediate output stage 49 includes a p-channel MOS transistor 47 as a driving transistor for receiving an output from the differential amplification stage 46, and an n-channel MOS transistor 48 as a constant-current source. The final output stage 52 includes an n-channel MOS transistor 50 as a driving transistor for receiving an output from the intermediate output stage 49, and a p-channel MOS transistor 51 as a constant-current source. Note that a predetermined bias voltage VNB is applied to the gate of each of the MOS transistors 45 and 48, and a predetermined bias voltage VPB is applied to the gate of the MOS transistor 51.

In the power amplifier having the above arrangement, an n-channel MOS transistor is used as the MOS transistor 43 for receiving the input voltage V2 on the differential amplification stage 46. With this arrangement, a reduction in the margin of the operating point can be prevented, unlike the case wherein a p-channel MOS transistor is used. In addition, on the final output stage 52, a sufficient amount of current can be caused to flow into the amplifier via an output terminal 53 by the n-channel MOS transistor 50. Therefore, a rise in the output voltage VLC2 toward the voltage VLC0 can be prevented, and the value of the voltage VLC2 can be stably maintained.

Figure 12:
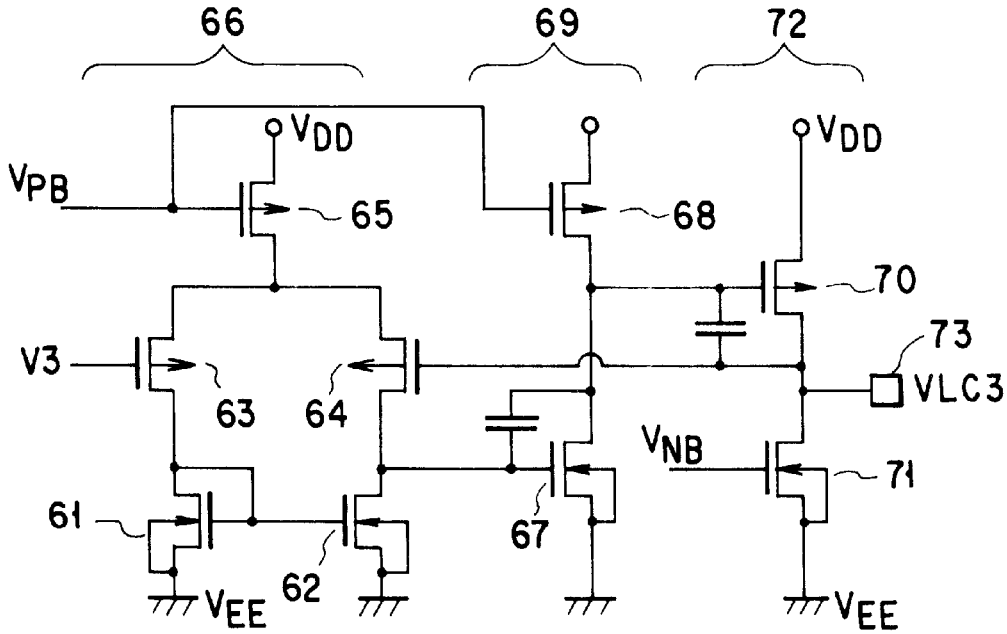
FIG. 12 is a circuit diagram of another power amplifier used in the circuit of the third embodiment in FIG. 10.

FIG. 12 shows the detailed arrangement of the Ptop type power amplifier AMP23 used in the circuit of the third embodiment. The Ptop type power amplifier AMP23 is constituted by a differential amplification stage 66, an intermediate output stage 69, and a final output stage 72. The differential amplification stage 66 includes n-channel MOS transistors 61 and 62 serving as a current mirror load, p-channel MOS transistors 63 and 64 serving as a differential input pair, and a p-channel MOS transistor 65 as a constant-current source. The intermediate output stage 69 includes an n-channel MOS transistor 67 as a driving transistor for receiving an output from the differential amplification stage 66, and a p-channel MOS transistor 68 as a constant-current source. The final output stage 72 includes a p-channel MOS transistor 70 as a driving transistor for receiving an output from the intermediate output stage 69, and an n-channel MOS transistor 71 as a constant-current source. Note that the predetermined bias voltage VPM is applied to the gate of each of the MOS transistors 65 and 68, and the predetermined bias voltage VN is applied to the gate of the MOS transistor 71.

In the power amplifier having the above arrangement, a p-channel MOS transistor is used as the MOS transistor 63 for receiving the input voltage V3 on the differential amplification stage 64. With this arrangement, a reduction in the margin of the operating point can be prevented, unlike the case wherein an n-channel MOS transistor is used. In addition, in the final output stage 72, a sufficient amount of current can be caused to flow out of the amplifier via an output terminal 73 by the p-channel MOS transistor 70. Therefore, a drop in the output voltage VLC3 toward the voltage VLC5 can be prevented, and the value of the voltage VLC3 can be stably maintained.

Figure 13:
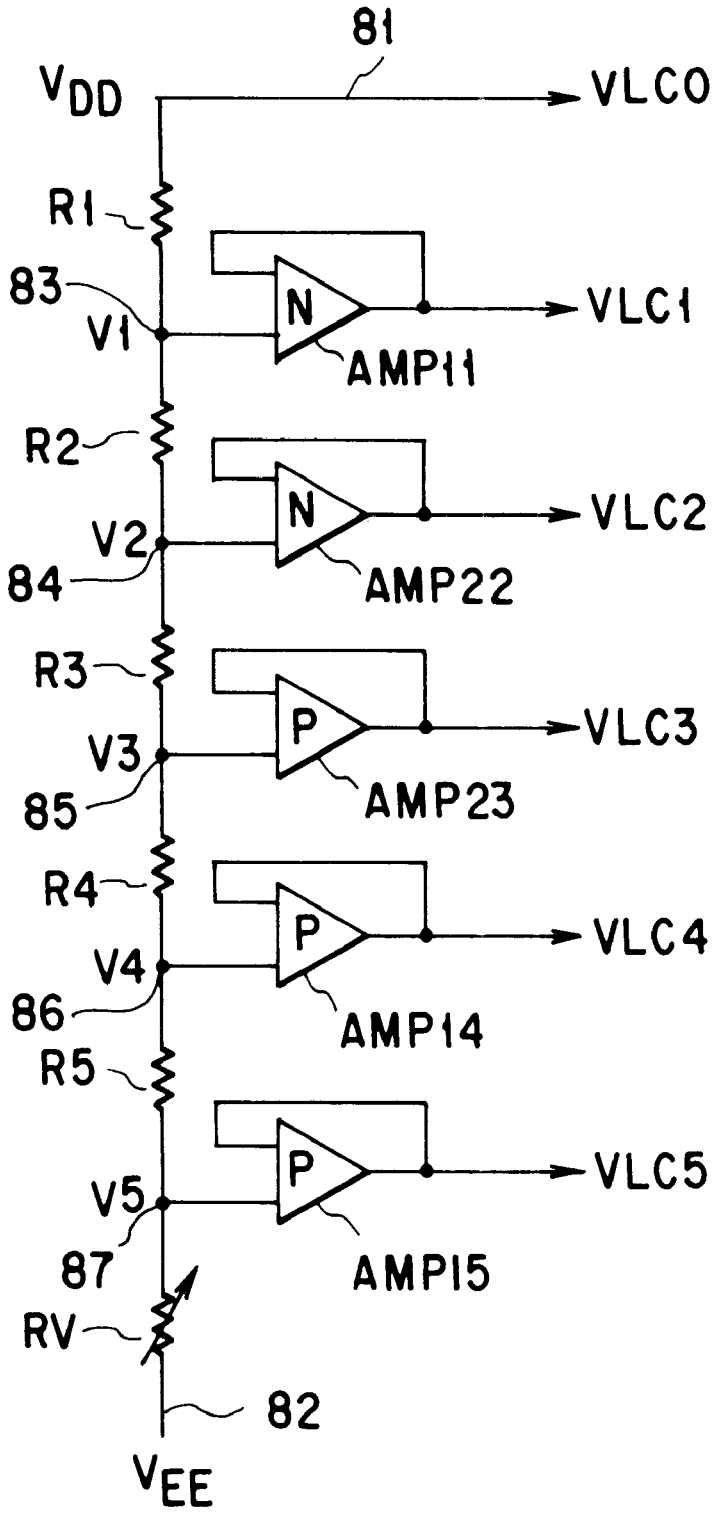
FIG. 13 is a circuit diagram of the fourth embodiment of the present invention.

FIG. 13 shows a power supply circuit according to the fourth embodiment of the present invention. In the circuit of the embodiment shown in FIG. 10, the external power supply voltage VEE is changed to set a display contrast. In the fourth embodiment, a variable resistor RV is inserted between the resistor R5 in FIG. 10 and an external power supply voltage VEE having a fixed value, and the values of liquid crystal driving voltages VLC1 to VLC5 are changed by adjusting the variable resistor RV. In this case, a voltage V5 corresponding to the voltage VLC5 is also formed by a voltage dividing operation using resistors. For this reason, a power amplifier AMP15 as an impedance conversion means is connected to a node 87 of this voltage V5. Note that a Ptop type amplifier like the one shown in FIG. 4 can be used as this power amplifier AMP15.

As has been described above, according to the present invention, a liquid crystal driving power supply circuit capable of further reducing the current consumption can be provided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A liquid crystal driving power supply circuit comprising:

a first power supply voltage node to which a first power supply voltage is applied;

a second power supply voltage node applied with a second power supply voltage lower in value than said first power supply voltage;

a voltage divider generating first, second, third and fourth divided voltages by dividing a voltage between said first and second power supply voltage nodes;

a first impedance conversion circuit including a first input terminal being applied with said first divided voltage and a first output terminal, and a first output transistor interposed between said first power supply voltage node and said first output terminal, and a second output transistor interposed between said first output terminal and said second power supply voltage node, wherein a current driving capacity of said first output transistor is greater than a current driving capacity of said second output transistor;

a second impedance conversion circuit including a second input terminal being applied with said second divider voltage and a second output terminal, and a third output transistor interposed between said first power supply voltage node and said second output terminal, and a fourth output transistor interposed between said second output terminal and said second power supply voltage node, wherein a current driving capacity of said fourth output transistor is greater than a current driving capacity of said third output transistor;

a third impedance conversion circuit including a third input terminal being applied with said third divided voltage and a third output terminal, a fifth output transistor interposed between said first power supply voltage node and said third output terminal, and a sixth output transistor interposed between said third output terminal and said second power supply voltage node, wherein a current driving capacity of said fifth output transistor is greater than the current driving capacity of said sixth output transistor; and a fourth impedance conversion circuit including a fourth input terminal being applied with said fourth divided voltage and a fourth output terminal, a seventh output transistor interposed between said first power supply voltage node and said fourth output terminal, and an eighth output transistor interposed between said fourth output terminal and said second power supply voltage node, wherein a current driving capacity of said eighth output transistor is greater than a current driving capacity of said seventh output transistor.

2. The circuit according to claim 1, wherein said voltage divider comprises a plurality of resistors connected in series between said first and second power supply voltage nodes.

3. The circuit according to claim 1, wherein:

said first output transistor comprises a p-channel first MOS transistor having a first source, a first drain, and a first gate, wherein a voltage corresponding to said first divided voltage is applied to said first gate and a first source-drain path is connected between said first power supply voltage node and said first output terminal;

said second output transistor comprises an n-channel second MOS transistor having a second source, a second drain, and a second gate, wherein a first bias voltage is applied to said second gate and a second source-drain path is connected between said first output terminal and said second power supply voltage node;

said third output transistor comprises a p-channel third MOS transistor having a third source, a third drain, and a third gate, wherein a second bias voltage is applied to said third gate and a third source-drain path is connected between said first power supply node and said second output terminal;

said fourth output transistor comprises an n-channel fourth MOS transistor having a fourth source, a fourth drain, and a fourth gate, wherein a voltage corresponding to said second divided voltage is applied to said fourth gate and a fourth source-drain path is connected between said fourth output terminal and said second power supply voltage node;

said fifth output transistor comprises a p-channel fifth MOS transistor having a fifth source, a fifth drain, and a fifth gate, wherein a voltage corresponding to said third divided voltage is applied to said fifth gate and a fifth source-drain path is connected between said first power supply voltage node and said third output terminal;

said sixth output transistor comprises an n-channel sixth MOS transistor having a sixth source, a sixth drain, and sixth gate, wherein a third bias voltage is applied to said sixth gate and a sixth source-drain path is connected between said third output terminal and said second power supply voltage node;

said seventh output transistor comprises a p-channel seventh MOS transistor having a seventh source, a seventh drain, and a seventh gate, wherein a fourth bias voltage is applied to said seventh gate and a seventh source-drain path is connected between said first power supply voltage node and said fourth output terminal; and said eighth output transistor comprises an n-channel eighth MOS transistor having an eighth source, an eighth drain, and an eighth gate, wherein a voltage corresponding to said fourth divided voltage is applied to said eighth gate and an eighth source-drain path is connected between said fourth output terminal and said second power supply voltage node.

4. The circuit according to claim 1, wherein said first impedance conversion circuit comprises, a first differential amplification stage including an n-channel first MOS transistor having a first source, a first drain, and a first gate for receiving the first divided voltage at the first gate, an n-channel second MOS transistor having a second source, a second drain, and a second gate, said first MOS transistor and said second MOS transistor forming a first differential pair, p-channel third and fourth MOS transistors forming a current mirror load with respect to the first and second MOS transistors, and a first current source for supplying a current to the first differential pair, and a first output stage including a p-channel fifth MOS transistor having a fifth source, a fifth drain, and a fifth gate, wherein an output voltage from said first differential amplification stage is applied to said fifth gate and a fifth source-drain path is connected between said first output terminal and said first power supply voltage node, said first output stage further including a second current source interposed between said first output terminal and said second power supply voltage node;

said second impedance conversion circuit comprises, a second differential amplification stage including a p-channel sixth MOS transistor having a sixth source, a sixth drain, and a sixth gate for receiving the second divided voltage at the sixth gate, a p-channel seventh MOS transistor having a seventh source, a seventh drain, and a seventh gate, said sixth MOS transistor and said seventh MOS transistor forming a second differential pair, n-channel eighth and ninth MOS transistors forming a current mirror load with respect to the sixth and seventh MOS transistors, and a third current source for supplying a current to the second differential pair, and a second output stage including an n-channel tenth MOS transistor having a tenth source, a tenth drain, and a tenth gate, wherein an output voltage for said second differential amplification stage is applied to said tenth gate and a tenth source-drain path is connected between said second output terminal and said second power supply voltage node, said second output stage further including a fourth current source interposed between said first power supply voltage node and second output terminal;

said third impedance conversion circuit comprises, a third differential amplification stage including an n-channel eleventh MOS transistor having an eleventh source, an eleventh drain, and an eleventh gate for receiving the third divided voltage at the eleventh gate, an n-channel twelfth MOS transistor having a twelfth source, a twelfth drain, and a twelfth gate, said eleventh MOS transistor and said twelfth MOS transistor forming a third differential pair, p-channel thirteenth and fourteenth MOS transistors forming a current mirror load with respect to the eleventh and twelfth MOS transistors, and a fifth current source for supplying a current to the third differential pair, and a third output stage including a p-channel fifteenth MOS transistor having a fifteenth source, a fifteenth drain, a fifteenth gate, wherein an output voltage from said third differential amplification stage is applied to said fifteenth gate and a fifteenth source-drain path is connected between said first power supply voltage node and said third output terminal, said third output stage further including a sixth current source interposed between said third output terminal and said second power supply voltage node; and said fourth impedance conversion circuit comprises, a fourth differential amplification stage including a p-channel sixteenth MOS transistor having a sixteenth source, a sixteenth drain, and a sixteenth gate for receiving the fourth divided voltage at the sixteenth gate, a p-channel seventeenth MOS transistor having a seventeenth source, a seventeenth drain, and a seventeenth gate, said sixteenth MOS transistor and said seventeenth MOS transistor forming a fourth differential pair, n-channel eighteenth and nineteenth MOS transistors forming a current mirror load with respect to the sixteenth and seventeenth MOS transistors, and a seventh current source for supplying a current to the fourth differential pair, and a fourth output stage including an n-channel twentieth MOS transistor having a twentieth source, a twentieth drain, and a twentieth gate, wherein an output voltage from said fourth differential amplification stage is applied to said twentieth gate and a twentieth source-drain path is connected between said fourth output terminal said first power supply voltage node, and said fourth output stage further including an eighth current source interposed between said first power supply voltage node and said fourth output terminal.

5. The circuit according to claim 4, wherein each of the first, second, fifth, and sixth current sources comprises an n-channel MOS transistor having a gate to which a predetermined bias voltage is applied and each of the third, fourth, seventh and eighth current sources comprises a p-channel MOS transistor having a gate to which a predetermined bias voltage is applied.

6. The circuit according to claim 1, wherein said first impedance conversion circuit comprises, a first differential amplification stage including an n-channel first MOS transistor having a first source, a first drain, and a first gate for receiving the first divided voltage at the first gate, an n-channel second MOS transistor having a second source, a second drain, and a second gate, said first MOS transistor and said second MOS transistor forming a first differential pair, p-channel third and fourth MOS transistors forming a current mirror load with respect to the first and second MOS transistors, and a first current source for supplying a current to the first differential pair, and a first output stage including a p-channel fifth MOS transistor, having a fifth source, a fifth drain, and fifth gate, wherein an output voltage from said first differential amplification stage is applied to said fifth gate and a fifth source-drain path is connected between said first power supply voltage node and said first output terminal, said first output stage further including a second current source interposed between said first output terminal and said second power supply voltage node;

said second impedance conversion circuit comprises, a second differential amplification stage including an n-channel sixth MOS transistor having a sixth source, a sixth drain, and a sixth gate for receiving the second divided voltage at the sixth gate, an n-channel seventh MOS transistor having a seventh source, a seventh drain, and a seventh gate, said sixth MOS transistor and said seventh MOS transistor forming a second differential pair, p-channel eighth and ninth MOS transistors forming a current mirror load with respect to the sixth and seventh MOS transistors, and a third current source for supplying a current to the second differential pair, a first intermediate output stage including a p-channel tenth MOS transistor having a tenth source, a tenth drain, and a tenth gate and a tenth source-drain path connected between said first power supply voltage node and a first intermediate output node, said first intermediate output stage receiving an output voltage from the second differential amplification stage at the tenth gate and further including a fourth current source connected between the first intermediate output node and said second power supply voltage node, and a first final output stage including an n-channel eleventh MOS transistor having an eleventh source, an eleventh drain, and an eleventh gate, wherein an output voltage from said first intermediate output node of said first intermediate output stage is applied to said eleventh gate and an eleventh source-drain path is connected between said second output terminal and second power supply voltage node, said first final output stage further including a fifth current source interposed between said first power supply voltage node and said second output terminal;

said third impedance conversion circuit comprises, a third differential amplification stage including a p-channel twelfth MOS transistor having a twelfth source, a twelfth drain, and a twelfth gate for receiving the third divided voltage at the twelfth gate, a p-channel thirteenth MOS transistor having a thirteenth source, a thirteenth drain, and a thirteenth gate, said twelfth MOS transistor and said thirteenth MOS transistor forming a third differential pair, n-channel fourteenth and fifteenth MOS transistors forming a current mirror load with respect to the twelfth and thirteenth MOS transistors, and a sixth current source for supplying a current to the third differential pair, a second intermediate output stage including an n-channel sixteenth MOS transistor having a sixteenth source, a sixteenth drain, and a sixteenth gate and a sixteenth source-drain path connected between a second intermediate output node and said second power supply voltage node, said second intermediate output stage receiving an output voltage from the third differential amplification stage at the sixteenth gate and further including a seventh current source connected between said first power supply voltage node and the second intermediate output node, and a second final output stage including a p-channel seventeenth MOS transistor having a seventeenth source, a seventeenth drain, and a seventeenth gate, wherein an output voltage from said second intermediate output node of said second intermediate output stage is applied to said seventeenth gate and a seventeenth source-drain path is connected between said first power supply voltage node and said third output terminal, said second final output stage further including an eighth current source interposed between said third output terminal and said second power supply voltage node; and said fourth impedance conversion circuit comprises, a fourth differential amplification stage including a p-channel eighteenth MOS transistor having an eighteenth source, an eighteenth drain, and an eighteenth gate for receiving the fourth divided voltage at the eighteenth gate, a p-channel nineteenth MOS transistor having a nineteenth source, a nineteenth drain, and a nineteenth gate, said eighteenth MOS transistor and said nineteenth MOS transistor forming a fourth differential pair, n-channel twentieth and twenty-first MOS transistors forming a current mirror load with respect to the eighteenth and nineteenth MOS transistors, and a ninth current source for supplying a current to the fourth differential pair, and a fourth output stage including an n-channel twenty-second MOS transistor, having a twenty-second source, a twenty-second drain, and a twenty-second gate, wherein an output voltage from said fourth differential amplification stage is applied to said twenty-second gate and a twenty-second source-drain path is connected between a fourth output terminal and said second power supply voltage node, said fourth output stage further including a tenth current source interposed between said first power supply voltage node and said fourth output terminal.

7. The circuit according to claim 6, wherein each of the first, second, third, fourth, and eighth current sources comprise an n-channel MOS transistor having a gate to which a predetermined bias voltage is applied.

8. The circuit according to claim 1, wherein a value of the second power supply voltage applied to said second power supply voltage node is variable.

9. The circuit according to claim 1, further comprising a variable resistor connected between said second power supply voltage node and said voltage divider.

10. The circuit according to claim 9, further comprising fifth impedance conversion circuit for receiving a voltage from a connection node between said second power supply voltage node and said variable resistor.

11. The circuit according to claim 10, wherein said fifth impedance conversion circuit includes a fifth input terminal for receiving the voltage at the connection node between said second power supply voltage node and said variable resistor and a fifth output terminal, a ninth output transistor interposed between said first power supply voltage node and said fifth output terminal, and a tenth output transistor interposed between said fifth output terminal and said second power supply voltage node, wherein a current driving capacity of said tenth output transistor is greater than a current driving capacity of said ninth output transistor.

* * * * *